US005553344A

United States Patent [19]

Rosenkrantz

[11] Patent Number: 5,553,344

[45] Date of Patent: Sep. 10, 1996

[54] PICK-UP DEVICE

[76] Inventor: Evelyn Rosenkrantz, 4915 Tyrone Ave. 203, Sherman Oaks, Calif. 91423

[21] Appl. No.: 340,582

[22] Filed: Nov. 16, 1994

[51] Int. Cl.[6] ..... A47L 13/00

[52] U.S. Cl. ..... 15/104.002; 15/231

[58] Field of Search ..... 15/104.002, 231, 15/232, 144.1, 105, 111

[56] References Cited

U.S. PATENT DOCUMENTS

| | | | |
|---|---|---|---|
| 2,870,475 | 1/1959 | Scheuer et al. | 15/144.1 |
| 3,046,587 | 7/1962 | Hamburger | 15/111 |
| 4,319,379 | 3/1982 | Carrigan | 15/231 |

FOREIGN PATENT DOCUMENTS

| | | | |
|---|---|---|---|
| 2233882 | 1/1991 | United Kingdom | 15/104.002 |

*Primary Examiner*—Edward L. Roberts, Jr.

[57] ABSTRACT

The pick-up device includes a support platform having a first side and second side. An elongated handle is connected to the first side. A plurality of sheets of adhesive material are attached to the second side. The sheets are arranged in a sandwich type fashion. Each sheet has an outwardly facing tacky adhesive surface and is adapted to be exposed when a preceding outermost sheet is removed. The tacky adhesive surface serves to pick up lint and other light substances when placed against it.

7 Claims, 1 Drawing Sheet

PICK-UP DEVICE

BACKGROUND OF THE INVENTION

1. Field of the Invention

The present invention relates generally to cleaning apparatuses and more particularly to the removal of lint and other like material by the use of sheets of adhesive material.

2. Description of the Related Art

Various types of lint pick-up devices have been suggested by the prior art. Typically, these devices involve use of an adhesive tape. However, they are generally complicated devices which involve roller mechanisms for dispensing the tape.

For example, U.S. Pat. No. 4,727,616 issued to Kucera et. al., discloses a pick-up roller which comprises a support; a cylinder carried by the support for rotation about its longitudinal axis; and a plurality of windings of material wound about the cylinder. Each of the windings has an outwardly facing adhesive surface and has a continuous cut along the substantial portion of a line extending across each winding to define a circumferentially extending narrow band of uncut windings disposed proximate one edge of the cylinder.

U.S. Pat. No. 4,083,075, issued to M. A. Hester, discloses a device comprising a housing having an elongated handle connected thereto and a tape cartridge disposed therein, the housing further comprising means for selectively advancing the tape and the cartridge to present a tacky surface for contacting and thus removing litter. The tape cartridge comprises a first reel for supplying a length of tape and a second reel for taking up the length of tape. The tape advancing means rotates the second reel to thereby advance a length of tape from the first reel in response to a sequential movement of the cartridge from the first extended position to a second retracted position and back to the extended position.

U.S. Pat. No. 3,040,352, issued to N. B. Vian, discloses a device with a body portion thereof whereby a tubular roll of material having a sticky surface may be frictionally retained thereon. The body portion has a configuration that coacts with the tubular roll of adhesive material so that the roll of adhesive material is positively retained thereon without the use of special fasteners until removed by the user of the device.

U.S. Pat. No. 3,742,547, issued to M. Sohmer, discloses a device which includes a tube-like roller having a length of pressure sensitive adhesive material wound around the periphery of the roller. Removable disk shaped end members enclose the ends of the roller. An inverted V-shaped holder is connected to the end members. A handle extends perpendicular to the longitudinal axis of the roller and is connected to the apex of the inverted V-shaped holder.

None of the prior art devices are particularly inexpensive and simple in construction. Furthermore, because the prior art devices generally involve rollers, they are not very useful in cracks, crevices and, especially, corners.

OBJECTS AND SUMMARY OF THE INVENTION

Accordingly, a principal object of the present invention is to provide quick clean-up of carpets, lint, car seats, floors, walls, ceilings, clothes, etc.

A further object is to provide an improved lint remover which will be inexpensive to manufacture and adapted to be sold at prices which will encourage the use of such devices.

Still another object is to provide a lint removing implement having a removable handle.

Still another object is to provide a pick-up device which utilizes thin sheets of adhesive material which are disposable after use.

Yet another object is to provide a pick-up device that is readily useful in corners, seat cushions and other areas where lint accumulates and which a roller shape will not accommodate.

These objects are achieved by the present invention which is a pick-up device. The present invention, in its broad aspects, comprises a support platform having a first side and second side. An elongated handle is connected to the first side. A plurality of sheets of adhesive material are attached to the second side. The sheets are arranged in a sandwich type fashion. Each sheet has an outwardly facing tacky adhesive surface and is adapted to be exposed when a preceding outermost sheet is removed. The tacky adhesive surface serves to pick up lint and other light substances when placed against it. Thus, the present invention operates by the simple motion of "press (or push) down and pick up".

Other objects, advantages, and novel features will become apparent from the following detailed description of the invention when considered in conjunction with the accompanying drawings.

BRIEF DESCRIPTION OF THE DRAWINGS

The sole FIGURE is an exploded perspective view of the present invention.

DETAILED DESCRIPTION OF THE PREFERRED EMBODIMENTS

Figure 1:
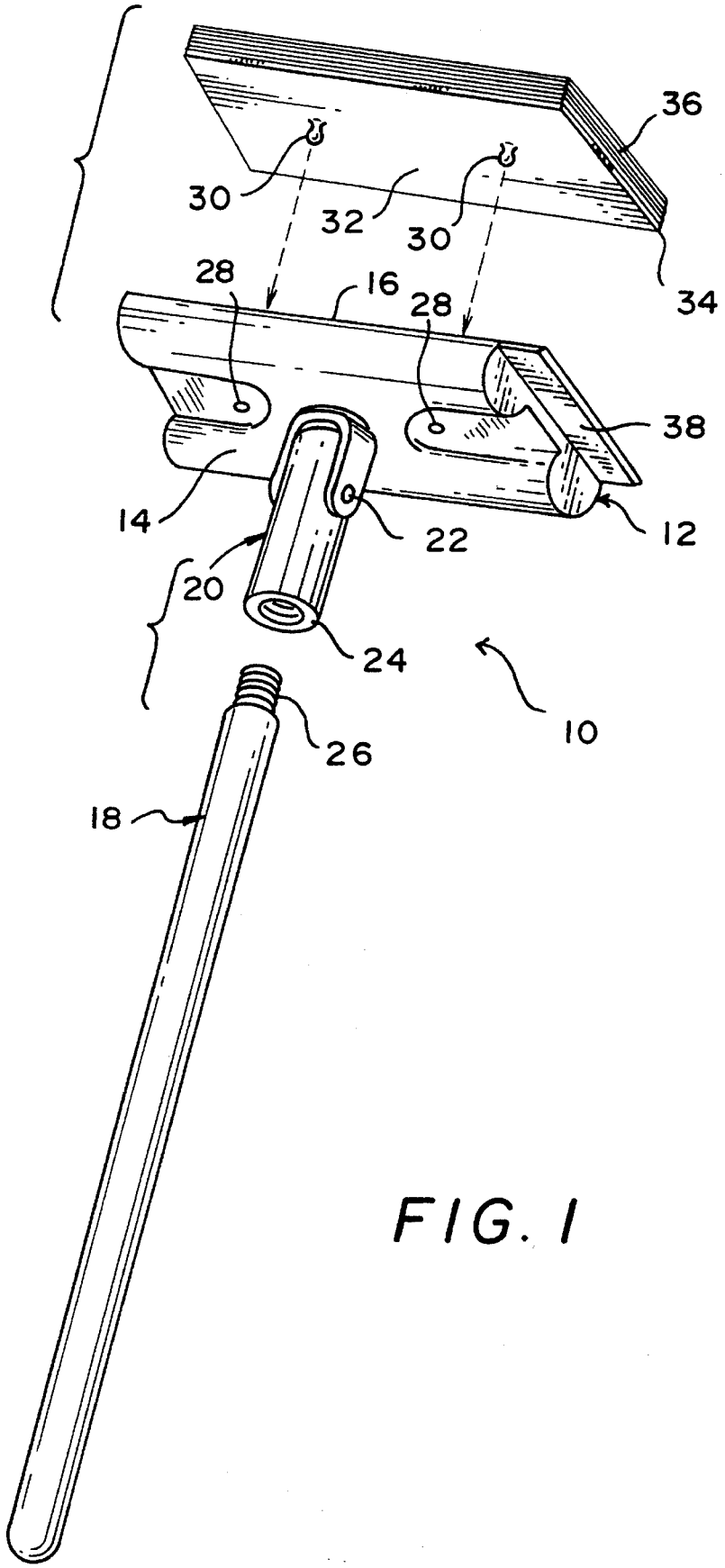

Referring now to the drawings and the characters of reference marked thereon FIG. 1 illustrates a preferred embodiment of the present invention, designated generally as 10. The pick-up device 10 includes a support platform 12 with a first side 14 and a second side 16. An elongated handle 18 is connected to the first side 14 through a receiving element 20. Receiving element 20 is connected to a main portion of the support platform 12 by means of a "U"-joint 22. The "U"-joint 22 provides angle adjustments as desired. The end 24 of the receiving element 20 has internal threads (not shown) which receive a first threaded end 26 of the handle 18. The handle 18 preferably has a substantially circular cross section.

The second side 16 of the support platform 12 includes openings 28 for receiving male elements 30 extending from a first surface 32 of a rigid backing base 34. The openings 28 receive the male elements 30 in a snapping manner, so that the backing base 34 becomes securely attached to the platform, 12.

The opposing side of the backing base 34 supports a plurality of sheets 36 of adhesive material. The sheets 36 are arranged in a sandwich type fashion, each sheet having an outwardly facing tacky, adhesive surface that is adapted to be exposed when a preceding outermost sheet is removed. The tacky adhesive surface of each sheet serves to pick up lint and other light substances when placed against it. The sheets of adhesive material may comprise, for example, 3M Brand ScotchPad™ custom imprinted type pads. This product comprises peel off sticky sheets. 3M Brand ScotchPad refers to sheets of an adhesive tape that can pick up substances that thus adhere to the tape surface but the tape itself cannot be slid along a horizontal surface in which it comes into contact with. That is, if one presses down an adhesive tape pad of ScotchPad brand tape onto a horizontal surface in a direction generally normal thereto, dirt or lint and the like will adhere to the tape surface but the tape pad itself cannot be slid along the upper surface of the horizontal surface. 3M Brand ScotchPad custom tape pads are manufacture by 3M of St. Paul, Minn.

Preferably, the backing base 34 and sheets 36 comprise a single unit which can be conveniently replaced by simply snapping in a new unit when the sheets 36 are used up. However, use of such a backing base 34 is not necessary and it is within the purview of this invention that the adhesive sheets 36 be connected directly to the support platform 12.

The support platform 12 also includes a scraping blade 38 to aid in loosening the light substances to be picked up, when necessary. The support platform 12 is, preferably, formed of injected molded plastic. Similarly, the backing base 34 is formed of a like rigid material. The support platform 12 is, preferably, substantially rectangular with a length in the range of approximately 5–15 inches and a width in the range of approximately 2–8 inches.

The handle is removable, as shown in the FIGURE, to allow the device to be used without such a handle. Although the handle is shown connected by means of threads 26 and a "U"-joint 22 it is within the purview of the present invention that the handle may connected by other means such as that which would be provided by a friction fit. The handle may be up to a few feet long (i.e. about four feet) to obviate the need for the user to bend down.

Obviously, many modifications and variations of the present invention are possible in light of the above teachings. It is, therefore, to be understood that within the scope of the appended claims, the invention may be practiced otherwise than as specifically described.

What is claimed and desired to be secured by Letters Patent of the United States is:

1. A pick-up device for picking up lint and other light substances, comprising:

a) a support platform including a plurality of openings therein, said support platform having a first side and a second side;

b) an elongated handle connectable to said first side;

c) a rigid planar backing base mountable upon said second side of said support platform, said backing base including a first side surface and a second side surface, a plurality of male elements extending from said first side surface, said male elements for being receivable by said plurality of openings so as to provide a snap fit therebetween; and d) a plurality of sheets of adhesive material, said sheets arranged in a sandwich type fashion, each sheet having an outwardly facing tacky, adhesive surface that is adapted to be exposed when a preceding outermost sheet is removed, said tacky adhesive surface serving to pick up lint and other light substances when placed against it.

2. The pick-up device of claim 1, wherein said support platform is substantially rectangular.

3. The pick-up device of claim 1, wherein said elongated handle is removably connected to said support platform so as to allow said platform to be optionally used without said handle.

4. The pick-up device of claim 1, wherein said handle has a substantially circular cross-section, with threads on a first end thereof, and wherein said second side of said support platform includes a receiving element having threads for receiving said first threaded end of said handle.

5. The pick-up device of claim 4, wherein said receiving element is connected to a main portion of said platform by means of a "U"-joint so as to provide angle adjustments.

6. The pick-up device of claim 1 wherein said support platform is substantially rectangular with a length in the range of approximately 5 to 15 inches and a width in the range of approximately 2 to 8 inches.

7. The pick-up device of claim 1, wherein said platform further comprises a scraping blade to aid in loosening said light substances to be picked up.

* * * * *